United States Patent [19]

Baker

[11] 4,383,578

[45] May 17, 1983

[54] CASING BORE RECEPTACLE WITH FLUID CHECK VALVE

[75] Inventor: John R. Baker, Houston, Tex.

[73] Assignee: Baker International Corporation, Orange, Calif.

[21] Appl. No.: 279,921

[22] Filed: Jul. 2, 1981

[51] Int. Cl.[3] ..... E21B 33/126; E21B 34/08

[52] U.S. Cl. ..... 166/373; 166/386; 166/319; 166/325

[58] Field of Search ..... 166/373, 374, 376, 382, 166/386, 387, 319, 321, 325, 217, 129, 133, 183, 188

[56] References Cited

U.S. PATENT DOCUMENTS

| | | | |
|---|---|---|---|
| 1,683,629 | 9/1928 | Robinson | 166/382 X |
| 3,086,593 | 4/1963 | Chitwood | 166/319 |
| 3,109,490 | 11/1963 | Baker | 166/114 |
| 3,747,682 | 7/1973 | Taylor | 166/386 |
| 4,290,484 | 9/1981 | Beall et al. | 166/387 X |

*Primary Examiner*—Stephen J. Novosad
*Assistant Examiner*—Thuy Bui
*Attorney, Agent, or Firm*—Robert W. Pitts; William C. Norvell, Jr.

[57] ABSTRACT

Apparatus for use in injecting treatment solutions through the annulus between two concentric conduits, such as tubing and casing, and then circulating it upwards with produced hydrocarbons. The apparatus comprises an integral valve and seal, including a mandrel, a packoff valve and a casing bore receptacle. The mandrel is incorporated in the tubing, and the casing bore receptacle is incorporated in the casing. The packoff member is releasably carriable on the mandrel and comprises an integral check valve and a radially expandable latch which is cammed outward by the relatively movable mandrel. The annular packoff member has seals on the interior and exterior surfaces for providing sealing integrity between the mandrel and the casing bore receptacle. The integral check valve permits fluids injected from above to flow radially across the packoff member between longitudinally annular flow paths defined by the packoff member and the casing, and by the packoff member and the mandrel. Net pressure in the annulus below the packoff member urges the check valve to the closed position.

28 Claims, 11 Drawing Figures

CASING BORE RECEPTACLE WITH FLUID CHECK VALVE

BACKGROUND OF THE INVENTION

1. Field of the Invention

This invention relates to sealing, packing, and valve systems used in subterranean oil and gas wells for providing an annular seal between a fluid transmission conduit disposed in another conduit or casing, and allowing one-way flow in the annulus to permit injection of treating fluids through the tubing-casing annulus.

2. Description of the Prior Art

There are many different downhole tools in the oil and gas industry which require that a seal be established in the annulus between a fluid transmission conduit or tubing string disposed in a well bore and the outer well casing. These tools may relate to the drilling and completion of the well, the production of the well, the servicing of the well, or the abandonment of the well. Conventional packers, employing an anchoring system for holding a sealing element in position against either upwardly or downwardly acting pressure differentials, are most often employed for establishing this seal. These conventional packers generally employ radially expandable anchor slip systems and radially expandable packing or sealing elements to prevent fluid communication and to provide pressure integrity. Such packers are typically run in and set in place either by or on a tubing string or a wireline setting tool. The packer is typically set using hydraulic pressure in the tubing, hydrostatic pressure in the well bore, tension applied through the tubing string, or a combination. It may also be mechanically set by the weight of the tubing. These packers can be permanent type packers with an internal seal bore for receiving tubing which can be retrieved while leaving the packer in place. Retrievable packers, employing techniques such as rotary manipulation of the tubing string to release anchor slip assemblies and packing elements for retrieval of the packer are also commonly employed.

In addition to the use of conventional packing elements to provide sealing integrity in the tubing casing annulus and to isolate the production zone from portions of the annulus extending above the packing element, casing polished bore receptacles have been employed in conjunction with sealing elements to achieve some of the objectives achieved by conventional packers. A typical prior art example of the use of packoff assemblies in conjunction with casing bore receptacles or liners is discussed on pages 6438 and 6439 of the 1978–79 Composite Catalog of Oil Field Equipment and Services published by World Oil.

It is generally necessary that sealing integrity be established between separate elements within the tubing string or between accessory items and the tubing string. For example, it is generally necessary that tubing sections, inserted into a seal bore of a packer, must have sealing integrity between that section and the packer. One means of providing such sealing integrity is to utilize stacks of sealing elements in which individual sealing elements have a generally chevron-shaped cross section. Sealing systems employing such chevron-shaped sealing elements are depicted on page 672 of the 1980–81 Composite Catalog of Oil Field Equipment and Services published by World Oil. These chevron-shaped sealing elements and systems, commonly referred to as tubing seal systems, could be employed to establish a seal between a tubing mounted element and the internal seal bore of a conventional packer. An alternative method of establishing a seal between a conventional packer and tubing elements while still permitting movement of the tubing elements relative to the packer is depicted in U.S. Pat. No. 3,109,490 covering a slidable latching seal assembly.

The present invention uses a casing bore receptacle concept and can employ conventional tubing seals to provide the seal between the tubing and the casing.

A seal assembly comprising a casing bore receptacle, an annular packoff member, and further comprising a radially expandable latch, and a reciprocal mandrel member is disclosed and claimed in my co-pending application entitled "Casing Bore Receptacle" filed 6-16-81.

In addition to providing a seal in the annulus between a fluid transmission conduit and an exterior conduit, it is often desirable to permit the injection of fluids into the annulus between the tubing and the casing. Such injection may be especially desirable in offshore wells where a treating fluid, such as a corrosion inhibitor or a kill fluid, is injected into the annulus to protect the tubing and the casing from highly corrosive produced hydrocarbons. It would be desirable to use tubing having the largest possible diameter to provide for the greatest possible production while, at the same time, providing for the injection of corrosion inhibitors and their circulation throughout the tubing and the casing. Due to the complex construction of packers it is difficult to incorporate both a passageway through the packer having a bore equivalent to that in the tubing and a valve mechanism having the capacity to permit the injection of a sufficient volume of corrosion inhibitor or kill fluid. The difficulty of achieving these objectives in one device based on a conventional packer is compounded where the available cross-sectional area between the tubing and the casing is limited.

One solution which has previously been suggested is to provide a polished bore receptacle along the casing in conjunction with a check valve located within the annulus. Such an arrangement will permit fluid to pass through the check valve, with the injected fluid passing therethrough down into those sections where the diameter of the well may be less, and subsequently into the tubing, and then up with the produced hydrocarbons through the tubing to the surface of the well. Latching means can also be employed in conjunction with the polished bore receptacle, the check valve, and tubing hangers located in the vicinity of the check valve.

The present invention provides a unique means of incorporating a check valve in an annular packoff assembly to allow both the injection of treatment fluids, such as corrosion inhibiting fluids, from above and to provide for adequately sealing the annulus in response to pressures existing in the annulus below the packoff member. In this way, the produced hydrocarbons cannot flow up through the tubing-casing annulus, but corrosion inhibiting fluids and solutions can flow down through the annulus to protect both the tubing and the casing over their entire length.

SUMMARY OF THE INVENTION

Apparatus for use in a subterranean well for injection of a fluid treatment solution through the annulus between tubing and casing and for subsequent circulation through the tubing includes a mandrel, an intermediate annular packoff member, and an exterior casing bore receptacle. The mandrel is incorporated as an integral member of the tubing intermediate the ends and has a flow path communicating with that in the tubing. The packoff member is releasably carriable on the mandrel and provides sealing integrity between the mandrel and the packoff member and between the packoff member and the casing. An integral check valve is incorporated in the packoff member. The valve opens under the force exerted by fluids in the annulus above the packoff member. In the presence of a net pressure below the packoff member, the valve closes to isolate the annulus above the packoff member from the production zone. A radially expandable latch on the packoff member secures the packoff member to the casing, but when the latch is expanded, the mandrel may move longitudinally relative to the packoff member. A camming shoulder on the mandrel urges the latch radially outward into engagement with the casing upon relative longitudinal movement between the packoff member and the mandrel.

BRIEF DESCRIPTION OF THE DRAWINGS

FIG. 1, comprising a series of running continuations, depicts the annulus seal and valve assembly employed in a subterranean well which contains an upper casing section and a liner of reduced diameter below the annulus seal and valve assembly and extending to the formation.

FIG. 2, comprising a series of running continuations, depicts an annulus seal and valve assembly similar to that shown in FIG. 1, with the valve closed prior to activation of the expandable latch to engage the casing.

FIG. 3, comprising a series of running continuations, depicts the tool shown in FIG. 2 in position to allow fluids injected above the annular seal and valve mechanism to flow through the annulus to the formation and then return up through the fluid transmission conduit.

DESCRIPTION OF THE PREFERRED EMBODIMENTS

Figure 1A:
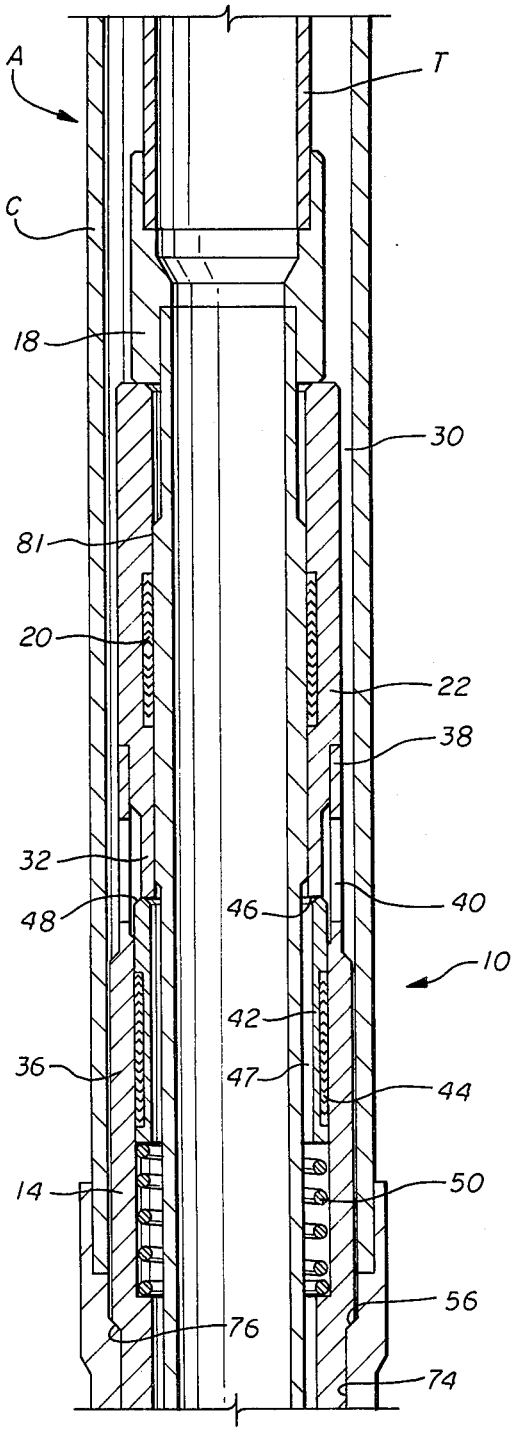
FIG. 1A shows the valve mechanism.

The annular seal and valve mechanism generally identified by the numerals 10 and 110, which comprise the preferred embodiments of this invention, can be used to establish a seal in the annulus A between a fluid transmission conduit or tubing T and an exterior conduit or casing C. The annular seal and valve mechanism 10 or 110, acts as a seal in response to a net pressure existing therebelow, but fluids injected into annulus A above this mechanism act to overcome the valve and flow through annular seal and valve mechanism. The preferred embodiments of this invention, in turn, comprises three members: a casing bore receptacle member 12 or 112, which is incorporated into casing C, comprises the outer member of this assembly; a mandrel 16 or 116, incorporated as an integral section in fluid transmission conduit T, in turn comprising the interior member; and an annular packoff member 14 or 114, initially carriable on the mandrel which comprises the central sealing and valve member. Annular packoff member 14 or 114 engages both the mandrel and the casing bore receptacle.

Figure 1B:
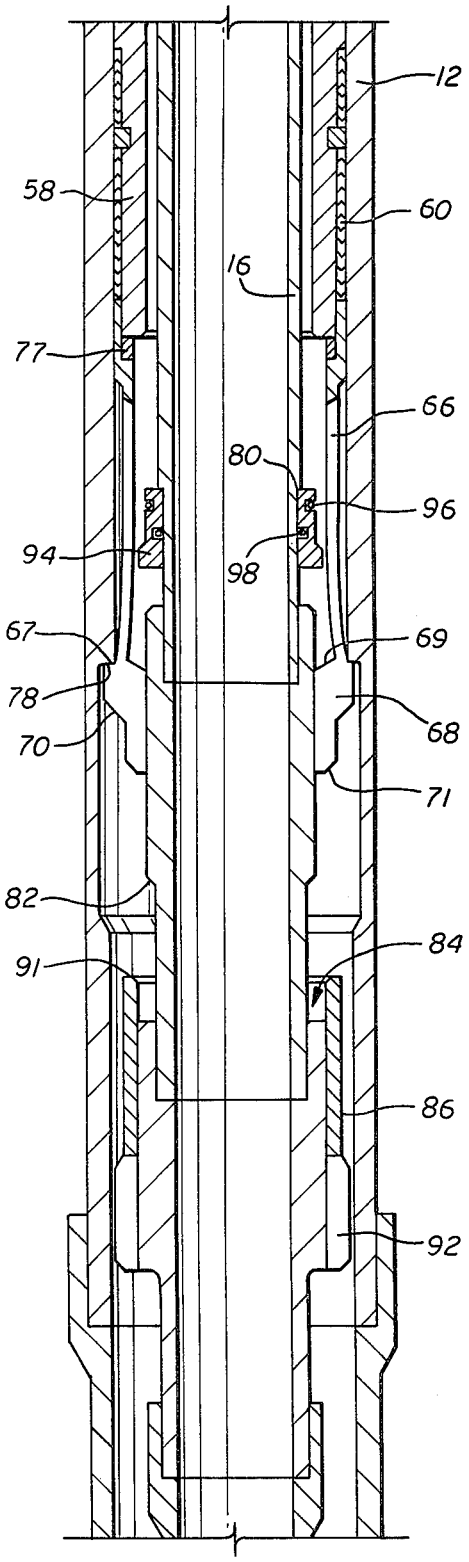
FIG. 1B shows a latching arrangement.
Figure 1C:
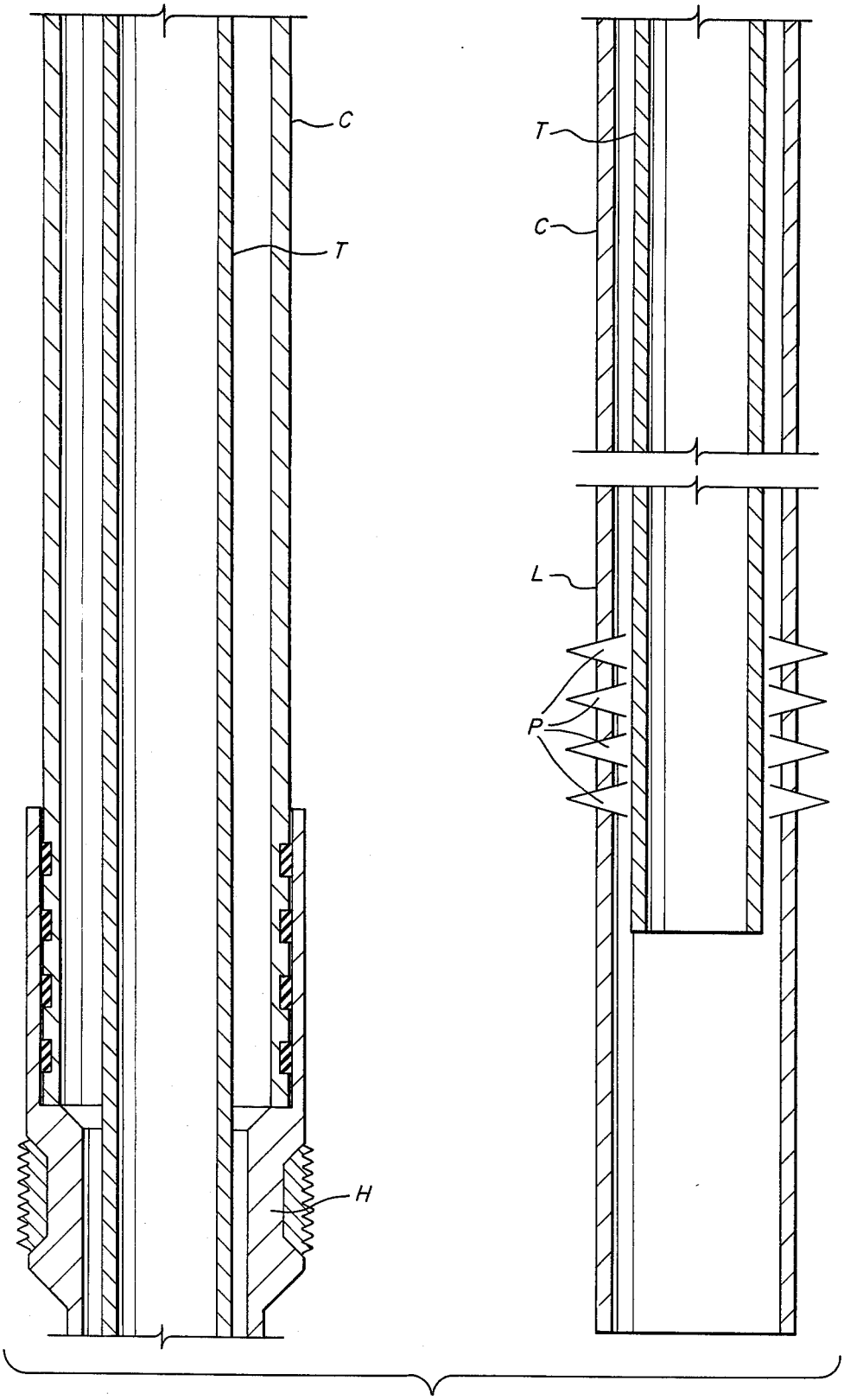
FIG. 1C shows the reduced diameter liner.
Figure 2A:
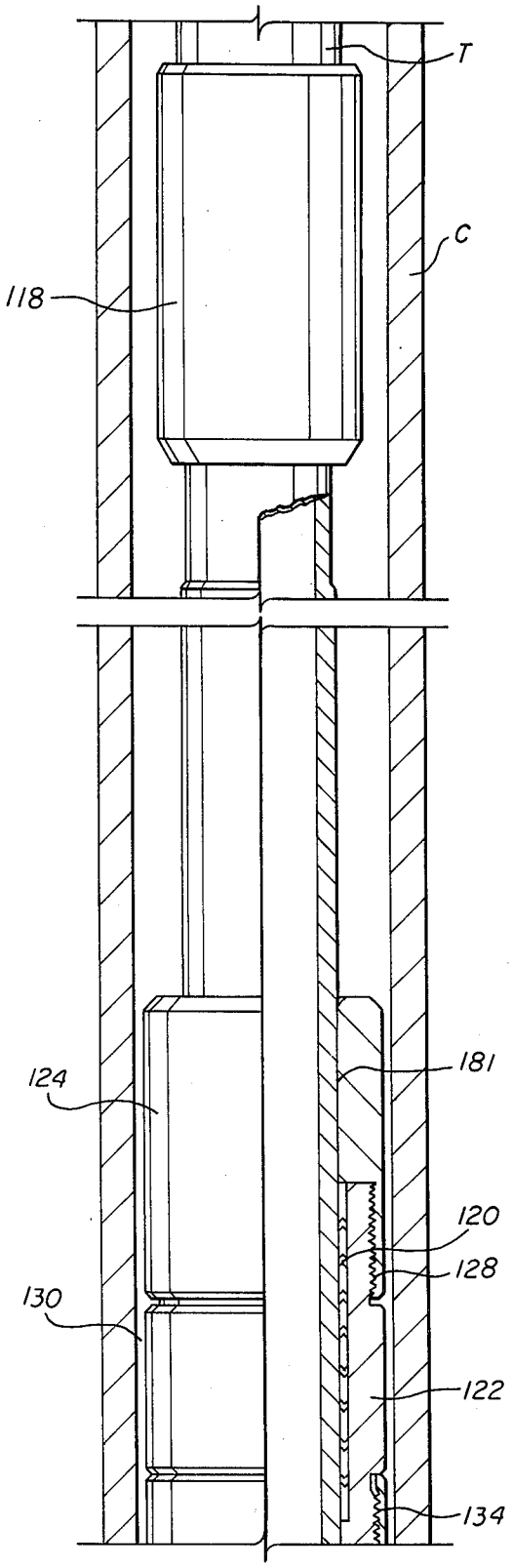
FIG. 2A shows the mandrel-to-packoff member seal.
Figure 2B:
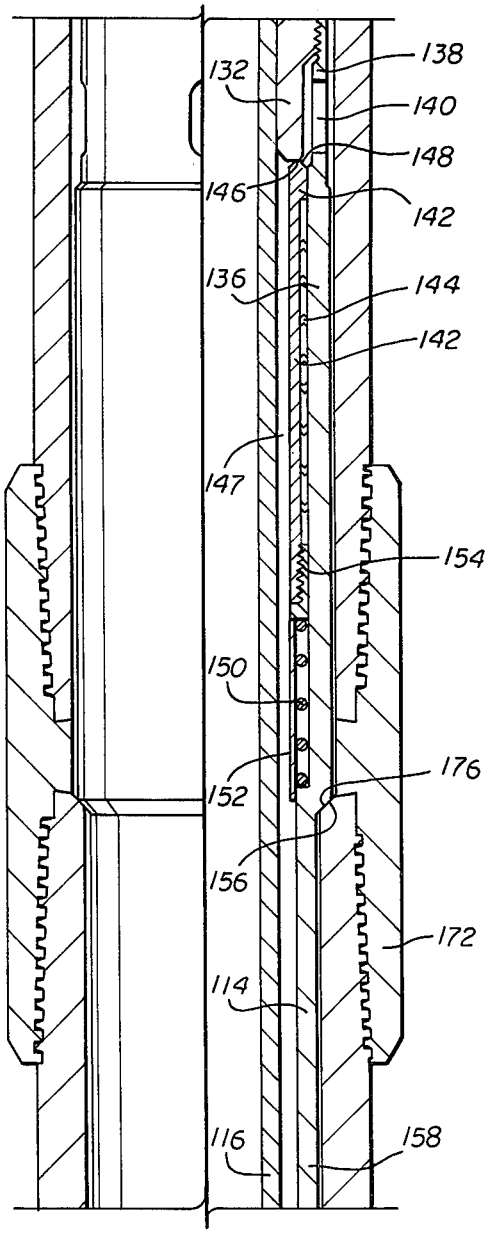
FIG. 2B shows the valve mechanism.
Figure 2C:
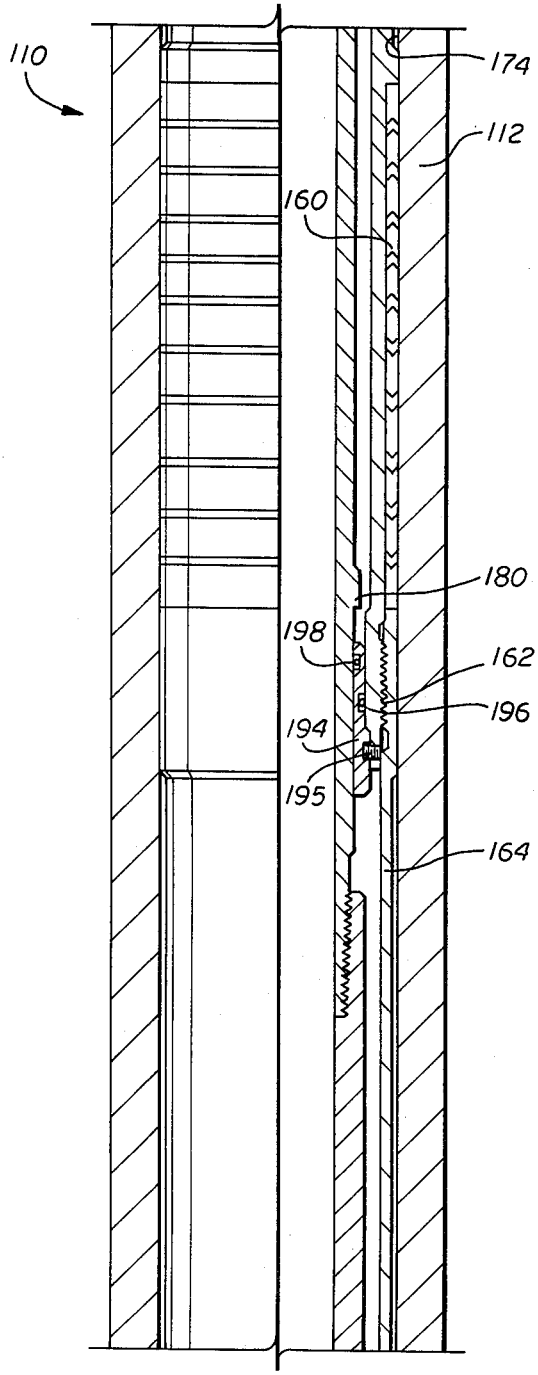
FIG. 2C shows the casing-to-packoff member seal.
Figure 2D:
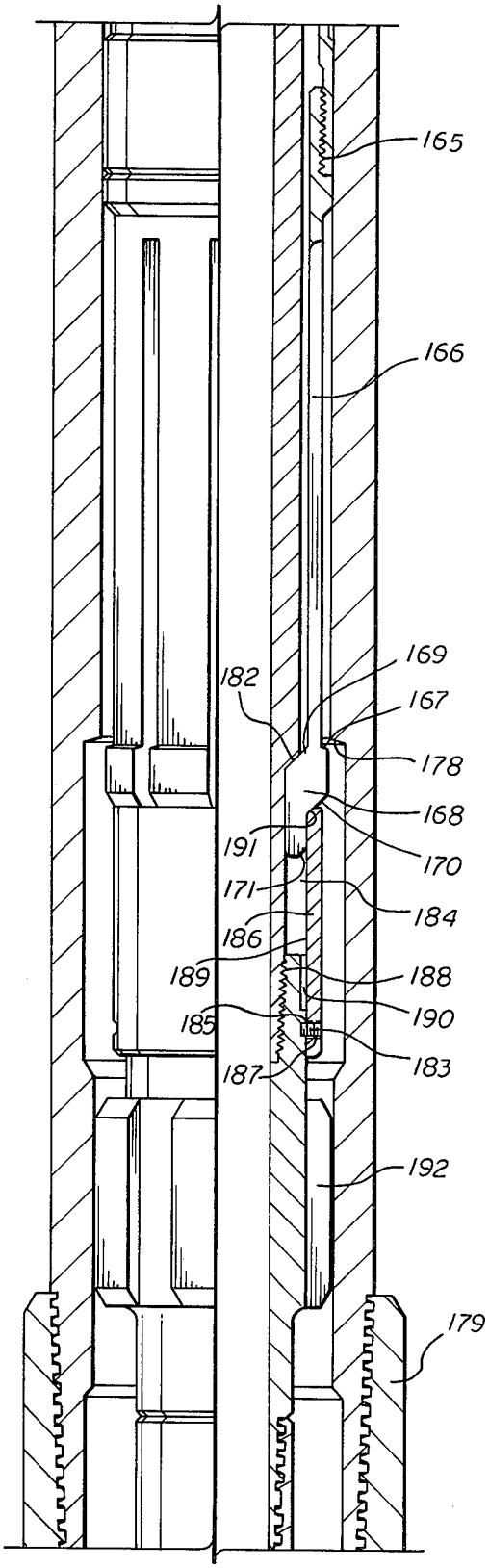
FIG. 2D shows the retracted latch.
Figure 3A:
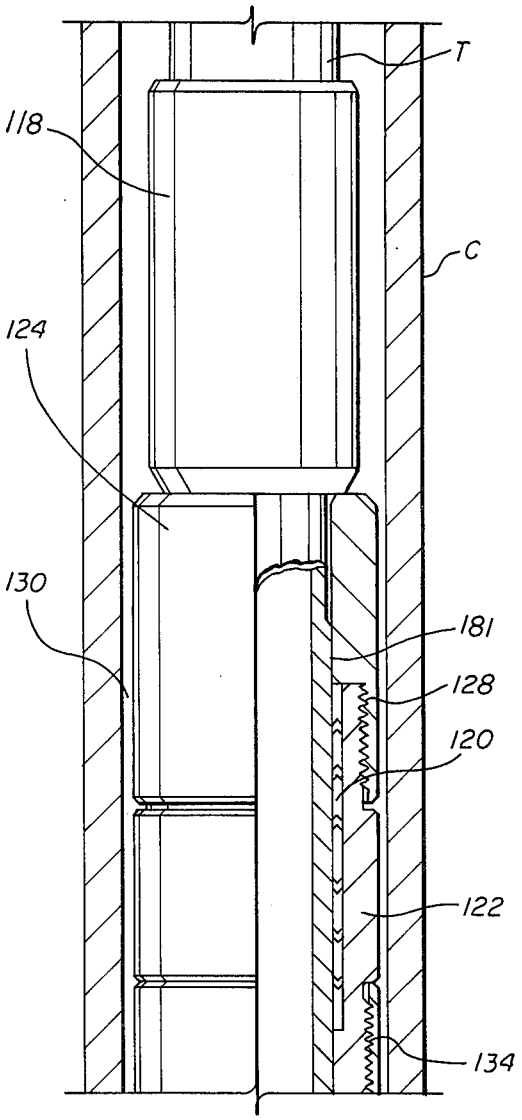
FIG. 3A shows the movement of the mandrel.
Figure 3B:
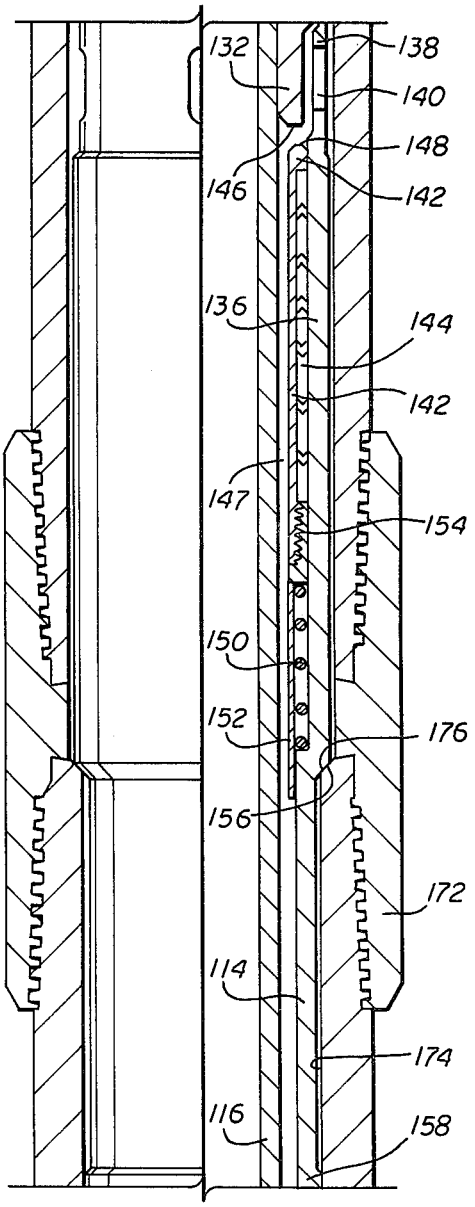
FIG. 3B shows the open valve.
Figure 3C:
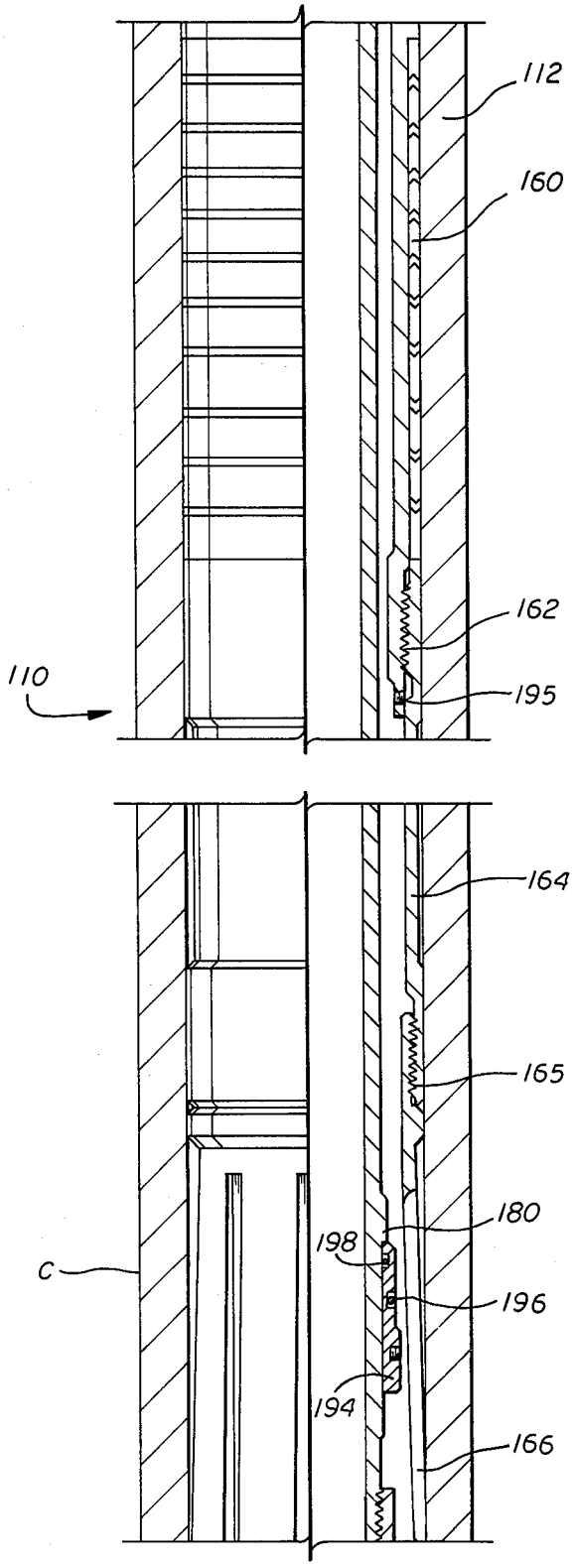
FIG. 3C shows the removed plug.
Figure 3D:
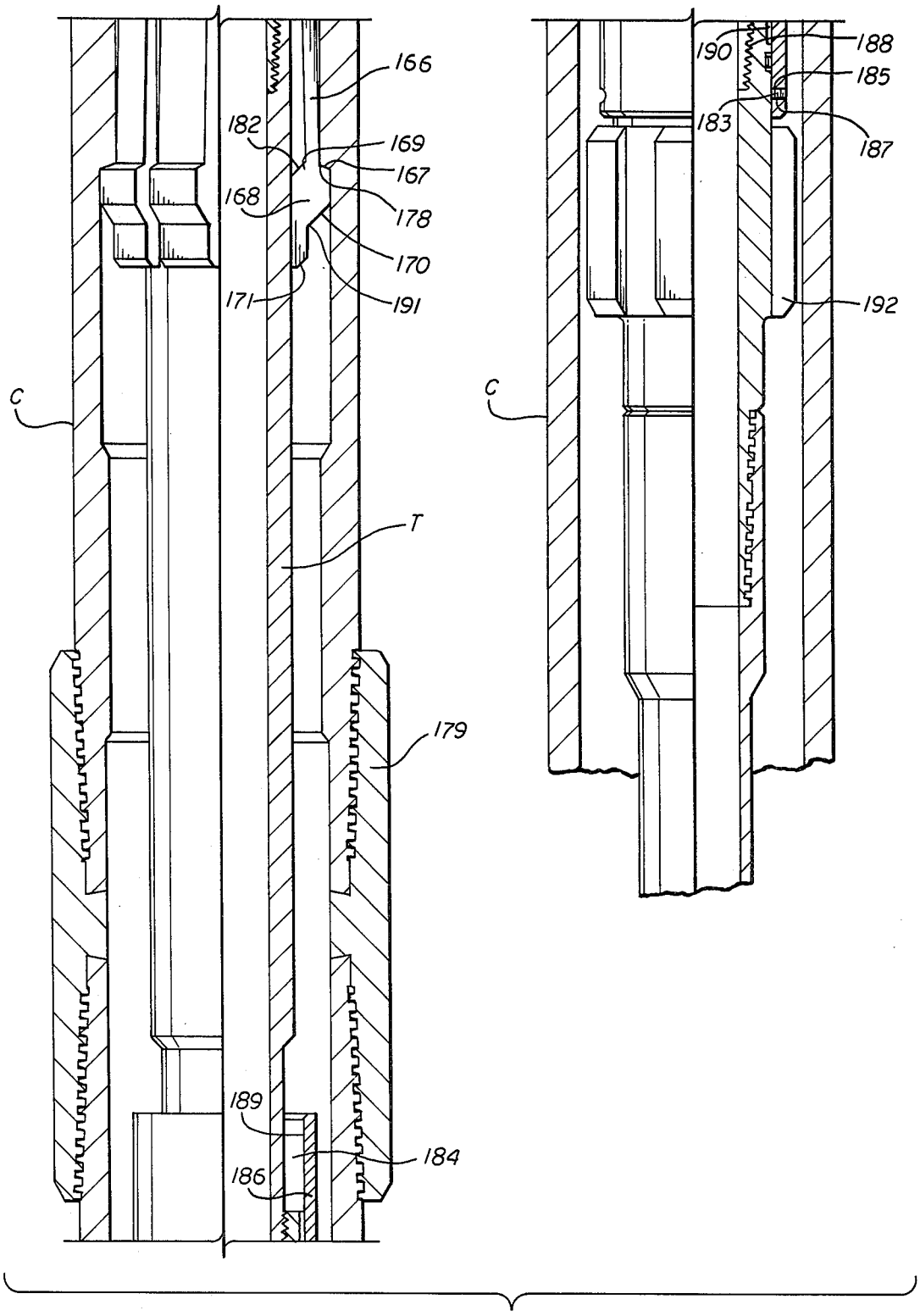
FIG. 3D shows the engaged latch.

One embodiment of the annular seal and valve assembly 10 is depicted in FIGS. 1A through 1C, which depict a subterranean well completion assembly comprising an exterior casing C with a liner L engaging casing C at a point below the location of annular seal and valve assembly 10. A hanger H, of conventional design, is used to suspend liner L from casing C. The use of liner L is necessitated by the reduced diameter of the well bore at greater depths. By positioning annular seal and valve assembly 10 within the larger diameter upper casing C, a larger diameter tubing section T can be employed within liner L. Regardless of the position at which this seal and valve assembly were employed, it would still be expected that the annular area in which both the seal and valve would act would be relatively small. Assuming all other conditions are generally equivalent, the use of the larger tubing section T should permit greater production rates.

Both the embodiment of FIG. 1 and the embodiment of FIGS. 2 and 3 could be employed in conjunction with a casing, tubing, liner hanger configuration shown in FIG. 1, as well as in numerous other configurations. Each embodiment could be positioned near the perforations or at a position some distance thereabove. After a discussion of both embodiments it will be apparent that each is run into position in much the same manner and each operates when set in the same manner. The embodiments differ primarily in the manner in which they are set. Since the second embodiment utilizes a somewhat more complex setting procedure, it is shown in both the running in configuration and in the set configuration. The embodiment of FIG. 1 is shown in only the set configuration which is sufficient for an understanding of its operation.

In FIG. 1, mandrel 16 is shown attached to an upper tubing section T by a coupling member 18. In the latched position, shown in FIGS. 1A through 1C, mandrel 16 has been completely extended into the bore defined by annular packoff member 14, and coupling member 18 abuts the upper end of the main packoff body member 22. A sealing member 20, suitable for establishing a dynamic seal between inner and outer relatively movably tubular components, is shown in engagement with mandrel 16 and annular packoff member 14. In this embodiment, seal 20 comprises a stack of discrete sealing members, some of which have a generally chevron-shaped cross section. This seal can be of conventional design employing primary elastomeric sealing elements. For example, a perfluoroelastomer, commonly referred to under the DuPont trademark "Kalrez", can be employed as the primary sealing element. Packoff body segment 22 terminates in a lower sleeve or extension 32 recessed from the outer surface of body segment 22. Sleeve 32 has a hard-faced surface 46 at its lower end. As shown in FIG. 1, annular packoff body segment 22 does not engage casing C. An outer annular flow passage, identified by the numeral 30, communicates with the tubing-casing annulus A. A second packoff body member 36, extending below upper body segment 22, is connected to body segment 22 by a conventional means, not shown in FIG. 1, above lower sleeve 32. Outer valve body 36 has ports 40 located in the general vicinity of sleeve 32. Circulation port 40 extends through and circumferentially around an upper outer sleeve extension 38, which extends from main packoff body member 36. A sealing element 44, similar to seal 20, is located along the interior surface of main packoff body member 36 near circulation port 40. Seal 44 is positioned along the contact surface between body member 36 and a movable check valve sleeve 42. Check valve sleeve 42 has a hard-faced upper surface 48 in contact with the similar surface 46 located on upper packoff body member 22 to form an annular metal-to-metal seal. The engagement between surfaces 46 and 48 prevents communication of a fluid through lower flow passage 47, transversely across packoff member 14 through ports 40 and then longitudinally along the upper annulus passage 30. A spring 50 engages both check valve sleeve 42 and main packoff body member 36 to urge surfaces 46 and 48 into contact, keeping the valve closed if little or no force is exerted through annulus A above packoff member 14. Seals 44 establish a seal along a surface having a larger diameter than the surface at which a seal if formed by the abutment of surfaces 46 and 48. Hydrostatic pressure, due to a column of fluids injected into the annulus above the valve, will then act on the area between seals 44 and the metal-to-metal seal formed by surfaces 46 and 48. Eventually, a force sufficient to depress the spring and open the valve will be developed by the pressure acting on this area. Pressure from below will act on this same area to provide an additional force tending to hold the valve in the closed position.

A downwardly facing annular shoulder 56 is located on the outer surface of main packoff body member 36 immediately below the longitudinal location of spring 50. Below shoulder 56 a third sealing member 60 is located along the outer surface of packoff body member 14. Seal 60 is generally equivalent to seal 20, although seal 60 will generally provide sealing integrity only between relatively immovable stationary members.

A radially expandable latch 66 extends from the lower end of packoff body member 36 and comprises a collet head 68. A latch comprising a plurality of individual collet fingers 66 are located circumferentially along the lower end of packoff member 14. In FIG. 1, collet member 66 is shown in its radially expanded position. Collet 66 comprises a collet head 68, having an exterior collet locking shoulder 67 on its outer upper face. An inclined surface 69 extends along the inner upper face of collet head 68 to form a camming engaging surface. Along the lower surface of collet head 68, two inclined outer surfaces 70 and 71 provide appropriate mating surfaces for a lock sleeve 86, which engages collet 68 in its radially retracted position.

In the preferred embodiments of this invention, such as that shown in FIG. 1, the annular seal and valve assembly 10 also comprises a casing bore receptacle 12 incorporated as an integral component of casing or exterior conduit C. Although the invention may conceivably be practiced without the use of casing bore receptacle 12, the use of a casing bore receptacle does provide for an appropriate inner sealing surface 74 which is generally not available on conventional casings. Casing bore receptacle 12 also comprises upper and lower shoulders 76 and 78 on opposite sides of casing bore receptacle sealing surface 74. Shoulder 76 is upwardly facing and shoulder 78 is downwardly facing. Casing receptacle sealing surface 74 would generally have an inner local diameter less than the local diameter of casing C. Note that in FIG. 1 seal 60 engages both packoff body member 36 and casing receptacle sealing surface 74. Casing bore receptacle 12 can be incorporated within casing C at the time of installation of the casing in the well by employing conventional connecting components, such as threads, which are not shown in FIG. 1.

Mandrel 16 can be incorporated in tubing T at the surface of the well and thereafter inserted into the well with the tubing. Mandrel 16 is positioned intermediate the ends of tubing T and is connected to tubing T by means of coupling members, such as coupling 18, which is of generally conventional design. As shown in FIG. 1, the packoff member 14 will support the mandrel 16 and the production tubing when coupling 18 abuts the upper surface of packoff member 14. The tubing weight is transferred through packoff member 14 to the casing bore receptacle 12. Mandrel 16 is not, however, fixed to packoff member 14 and longitudinal movement due to tubing contraction is possible.

Mandrel sealing surface 81 is located along an enlarged outer diameter segment of mandrel 16 and sealing integrity between mandrel surface 81 and the packoff member is provided by means of seal 22. A shoulder 80 is provided along the outer surface of mandrel section 16 below mandrel sealing surface 81. In FIG. 1, shoulder 80 is shown in engagement with a plug member 94. Below shoulder 80 a lock sleeve 86 extending generally concentric to mandrel 16 is affixed to the mandrel by conventional means. Lock sleeve 86 has an inclined inner surface 91 along its upper end. Lock sleeve 86 extends at least partially along the lower end of a recessed section 84 extending around the periphery of mandrel 16. Recess 84 terminates at its upper end in a camming shoulder 82. In the embodiment shown in FIG. 1B, the collet has engaged lower shoulder 78 on casing bore receptacle 12. Collet head 68 is spaced from recess 84 and shoulder 82. Collet head 68 is held in its radially expanding position by the outer surface of mandrel 16. Mandrel 16 further comprises a guide segment 92 positioned below lock sleeve 86. Guide segment 92 serves to retain mandrel 16 in a generally centered position as the tubing and mandrel are inserted into the casing.

An alternate embodiment is shown in FIGS. 2 and 3 in which the annulus seal and valve assembly 110 comprises packoff member 114, mandrel 116, and casing bore receptacle 112. Annular seal and valve assembly 110 is generally similar to assembly 10 shown in FIG. 1, with the primary difference being in the radially expanding latch mechanism. FIG. 2 illustrates that upper packoff body member 122 comprises a cap member 124 threadably engaged to a second body member 136 by means of threaded connection 134. Seals 120 extend between packoff body member 122 and mandrel 116 in the same fashion as similar seals 20 in FIG. 1. Upper packoff body member 122 is attached to main packoff body member 136 by means of a threaded connection 134 along extension sleeve 138. Circulation ports 140 are located in extension sleeve 138 and communicate between outer annular passage 130 and the valve mechanism positioned in main packoff body member 136. In FIG. 2, a check valve sleeve 142 is biased upward by a spring member 150 located along the inner surface of main packoff body member 136. Check valve sleeve 142 engages a surface 146 on upper packoff body member 122 along its upper hard-faced surface 148 in the same fashion as in FIG. 1. Seals 144 extend between check valve sleeve 142 and the main body segment 136 of packoff member 114. A lower sleeve 152 attached to check valve sleeve 142 by threads 154 retains spring member 150 between sleeve 142 and body member 136. A downwardly facing shoulder 156 on body member 136 is shown in engagement with an upwardly facing shoulder 176 on casing bore receptacle 112. This abutment, which takes place at a point adjacent to the lower end of spring 150 is similar to the engagement of surfaces shown in FIG. 1. Seals 160, generally equivalent to seal 60 in FIG. 1, provide sealing integrity between packoff member 114 and 112 along casing bore receptacle sealing surface 174. A collet member 166, generally equivalent to collet 66, is affixed to the lower portion of main body member 136 by means of an extension having threaded connections 162 and 165 at its upper and lower end, respectively. Collet head 168 has inner and outer upper inclined surfaces 167 and 169, generally equivalent to similar surfaces shown in FIG. 1. Lower camming and engaging surfaces 171 and 170 are located along the outer surface of collet head 168.

Casing bore receptacle 112 is generally equivalent to casing bore receptacle 12, shown in FIG. 1, and also has upper and lower shoulders on opposite sides of a central casing receptacle sealing surface. Mandrel 116 also has outer shoulders 180 and 182 similar to shoulders shown in FIG. 1. Mandrel 116 also has a recess 184 which can receive collet head 168, as shown in FIG. 2. The means of retaining collet head 168 in its retracted position differs in FIG. 2 from the embodiment shown in FIG. 1. A collet locking sleeve 186 is attached to mandrel 116 at its lower end, locking sleeve 186 engages the outer surface of collet head 168 between shoulders 170 and 171. A shear screw 183 extends through a mating hole in collet sleeve 186 and engages an appropriate recess 185 in the mandrel. The attachment between guide sleeve 186 and mandrel 116 also comprises a body lock ring 190 engaging mandrel wickers 188 and lock sleeve wickers 189. Lock ring 190 does not serve to retain lock sleeve 186 relative to mandrel 116 while shear screw 183 is in position. The embodiment shown in FIG. 2 also comprises a guide member 192 located below collet 168 to provide appropriate guidance for both the mandrel 116 and the packoff member 114 during insertion into the casing C.

A disengagable sealing plug 194 is shown in FIG. 2 in position to seal inner annular sealing passage 147 between mandrel 116 and packoff member 114. Sealing plug 194 has inner and outer O-ring seals 196 and 198. Plug 194 is held in position relative to packoff member 114 by means of a shear screw 195 extending therebetween.

OPERATION

In each of the embodiments depicted herein, the annular seal and valve assembly would normally comprise a casing bore receptacle incorporated as an integral element in the casing at the time the casing is originally installed in the well. This casing bore receptacle should be positioned at a predetermined point above a production zone where perforations P would eventually be made to allow production in the well. The annular packoff member and mandrel of either FIG. 1 or FIG. 2 could be employed with the casing and liner assembly shown in FIG. 1. FIG. 1 depicts a casing C which has a larger diameter than liner L extending to the perforations P where the diameter of the well is less than that existing thereabove.

When the mandrel and packoff member are to be inserted into the well, the mandrel, either mandrel 16 in FIG. 1 or mandrel 116 in FIG. 2, is incorporated as an integral component of the fluid transmission conduit or tubing T. The mandrel is located intermediate the ends of tubing T. When the mandrel section is attached to tubing T, packoff member, either 14 or 114, would be releasably affixed to the mandrel and would completely encircle the mandrel. Although the means of attachment does differ in detail, both the embodiments of FIG. 1 and FIG. 2 provide for a releasable attachment between packoff member, either 14 or 114, and its corresponding mandrel member 16 or 116, respectively. This releasable attachment is accomplished by use of a lock sleeve which is attached to the mandrel. In FIG. 1, lock sleeve 86 can either be attached to collet head 68 by a shear screw (not shown) or it can merely be positioned in partially encompassing relationship to collet head 68 to retain collet head 68 within recess 84 when the collet is in its radially inward position. In FIG. 2, this attachment does differ somewhat.

Engagement between the latching collet and the downwardly facing shoulder on the casing bore receptacle isolates the tubing from a substantial portion of the "piston effect" due to a pressure differential acting below the packoff members. In this latched configuration, this pressure between the tubing and the annulus will act on the packoff member. Any force exerted on the tubing will be limited to the pressure acting on the cross-sectional area of the tubing itself.

When packoff member 14 has reached its appropriate position within the casing C, downwardly facing annular shoulder 56 engages upwardly facing shoulder 176 on the casing bore receptacle to establish an abutment which will prevent packoff member 14 from moving downwardly relative to casing bore receptacle 12. Further downward movement of tubing T and mandrel 16 will cause shoulder 82 on the mandrel to engage inclined surface 69 on collet head 68 to urge collet head 68 outward. As collet head 68 is cammed outward by shoulder 82, locking shoulder 67 on collet head 68 will be forced into engagement with lower or downwardly facing shoulder 178 on casing bore receptacle 12. Collet head 68 will be held in its radially expanded position by the outer surface of mandrel 16 as the mandrel continues to move in a downward direction. The abutment between shoulders 56 and 78 and the engagement of collet head 68 prevents any longitudinal movement of the annular packoff member 14 relative to casing bore receptacle 12. Note that mandrel 16 can move downward with respect to both packoff member 14 and casing bore receptacle 12 until coupling 18 abuts packoff member 14 at its upper end.

The sealing and valve assembly 10 is now in position in the well and, as shown in FIG. 1, a pressure in the annulus A below the sealing assembly 10 greater than the pressure thereabove will prevent the valve mechanism from opening and will effectively isolate the production zone from the upper annulus A. However, the injection of treating fluids in annulus A above the sealing and valve assembly 10 will cause check valve sleeve 42 to move down against the action of spring 50. The treating fluid can then flow from the annulus through passage 30, through annular circulation port 40 between valve mating surfaces 46 and 48 in their open position, then through inner annular flow passage 47 and into the annulus below the seal and valve assembly 10. The cross-sectional flow area provided by the annular nature of this valve structure thus permits a relatively large amount of fluid to be injected through the annulus past the valve. The treating fluid can then flow to the production zone where perforations P have been established. This treating fluid can then return to the surface through the central flow transmission conduit which extends through tubing T and through a central flow passage extending in mandrel 16 at the point of which it is incorporated into the fluid transmission conduit. When mandrel 16 is removed from casing C, lock sleeve 86 will cause collet head 68 to be cammed inwardly upon engagement of outer camming surface 91 with inclined surface 71 on collet head 68. When lock sleeve 86 engages collet head 68, recess 84 will have moved into position below collet head 68 permitting the collet head to be moved inwardly and freeing packoff member 14 from casing bore receptacle 12. Both the mandrel 16 and the packoff member 14 can then be removed from the casing, leaving casing bore receptacle 12 in position.

The embodiment shown in FIG. 2 and FIG. 3 operates in much the same fashion. However, the latching engagement established by collet 66 in the embodiment of FIG. 2 differs from both the mechanism and method of engaging the collet in the embodiment of FIG. 1. The embodiment of FIG. 2 is especially adapted for use in deviated wells where friction or contact between collet head 68 in FIG. 1 and the casing C might otherwise prematurely dislodge collet 66, forcing premature engagement of the collet with the casing C. In the embodiment of FIG. 2. collet head 168 is, in effect, trapped between lock sleeve 186 and camming shoulder 182 on mandrel 116. Any force transmitted from the casing to collet head 168 will be transmitted directly to mandrel 116. There will, therefore, be no tendency for collet 168 to be prematurely expanded during insertion of the mandrel and packoff member into the well.

When shoulders 156 and 176 abut to prevent further downward movement of packoff member 114, the packoff member has reached its desired location within casing C. A shear screw 183 prevents further movement of mandrel 116 relative to packoff member 114 and lock sleeve 186. A predetermined force must be applied to mandrel 116 to move mandrel 116 downwardly with respect to packoff member 114 after shear screw 183 has been severed. In the embodiment of FIG. 2, however, this shearing force is not applied in the downward direction but is applied as an upward pull on mandrel 116. Prior to shearing screw 183, annulus A above packoff member 114 can be filled to hold packoff member 114 in position. By injecting fluids into annulus A, check valve sleeve 142 will be forced downward to open the valve between surfaces 146 and 148. However, a plug member 194 is held in position by means of shear screw 195, as shown in FIG. 2. Therefore, fluid may flow into passage 147 but it cannot flow past plug member 194 and into the annulus below packoff member 114. An upward force can then be exerted on mandrel 116 with a downward force provided by the fluid acting on packoff member 114. Shear screw 183 will then be severed. Upward force on the tubing T and the mandrel 116 will then cause mandrel 116 to move up relative to guide member 186. Upward movement of mandrel 116 will cause lock ring 190 to ratchet up along the wickers 189 located on lock sleeve 186. At this point, mandrel 116 and tubing T are moved downward. Downward movement, after screw 183 has been sheared, will move lock sleeve 186 away from collet head 168, freeing the collet to be urged radially outward by camming surface 182. Downward movement will also cause shoulder 180 on the mandrel to engage plug member 194. Engagement between shoulder 180 and plug member 194 will, upon exertion of sufficient force, shear screw 195 releasing plug 194 and opening flow passage 147. The seal and valve mechanism 110 will then be free to allow the passage of treating fluids injected into annulus A thereabove, and also to seal against pressures which may exist below the seal and valve mechanism 110. Retrieval of mandrel 116 and packoff member 114 can be accomplished in the same fashion as with the embodiment of FIG. 1. Again, lock sleeve 186 will engage collet head 168, camming the collet radially inward and freeing packoff member 114 from casing bore receptacle 112. The tubing T, the mandrel 116, and the packoff member 114 can then be removed from the well leaving casing bore receptacle 112 in place.

Although the invention has been described in terms of specified embodiments, which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for use in a subterranean well in which a fluid treatment solution is injected through the annulus between a fluid transmission conduit and an exterior conduit, and thereafter circulated with produced hydrocarbons through said fluid transmission conduit to the top of said well, comprising:

a mandrel incorporable in said fluid transmission conduit, said mandrel defining a flow path communicating with said fluid transmission conduit above and below said mandrel to prevent transmission of said produced hydrocarbons and said fluid treatment solution upwardly therethrough;

packoff means releasably carriable on said mandrel extending between said mandrel and said exterior conduit for establishing sealing integrity across said annulus;

valve means in said packoff means, being closed when subject to a net pressure from below said packoff means and being open under a net pressure from above said valve to allow said fluid treatment solution to flow downwardly through said packoff means;

radially expandable latching means on said packoff means for securing said packoff means to said exterior conduit, said mandrel being free to move longitudinally relative to said packoff means when said radially expandable latching means secures said packoff means to said exterior conduit; and camming means on said mandrel for engaging said radially expandable latching means and urging said latching means radially outward into engagement with said exterior conduit.

2. The apparatus of claim 1 wherein said mandrel further comprises a recess on the exterior thereof, said latching means being partially received within said recess when said latching means is in a radially retracted position.

3. The apparatus of claim 2 wherein said camming means comprises a shoulder extending radially outward from said recess on said mandrel.

4. The apparatus of claim 3 wherein said packoff member further comprises sealing means on the interior thereof for establishing sealing integrity with said mandrel and sealing means on the exterior thereof for establishing sealing integrity with said exterior conduit.

5. The apparatus of claim 4 further comprising a receptacle member incorporable in said exterior conduit and having a sealing bore, said sealing means on the exterior of said packoff member contacting said sealing bore.

6. The apparatus of claim 5 wherein said receptacle member further comprises an upwardly facing shoulder and a downwardly facing shoulder.

7. The apparatus of claim 6 wherein said packoff member further comprises means for engaging said upwardly facing shoulder to prevent further relative movement between said packoff member therebetween in a first longitudinal movement, further movement of said mandrel relative to said packoff member in said first direction camming said radially expandable latching means into engagement with said downwardly facing shoulder.

8. Apparatus for use in a subterranean well in which a fluid treatment solution is injected through the annulus between a fluid transmission conduit and an exterior conduit, and thereafter circulated with produced hydrocarbons through said fluid transmission conduit to the top of said well, comprising:

a mandrel incorporable in said fluid transmission conduit, said mandrel defining a flow path communicating with said fluid transmission conduit above and below said mandrel to permit transmission of said produced hydrocarbons and said fluid treatment solution upwardly therethrough;

packoff means releasably carriable on said mandrel extending between said mandrel and said exterior conduit for establishing sealing integrity across said annulus;

valve means in said packoff means, being closed under a net pressure below said packoff means and being open under a net pressure above said valve to allow said fluid treatment solution to flow downwardly through said packoff means; and radially expandable latching means on said packoff means, releasably attached to said mandrel and expandable to secure said packoff means to said exterior conduit, said mandrel being free to move longitudinally relative to said packoff means when said radially expandable latching means secures said packoff means to said exterior conduit.

9. Apparatus for use in a subterranean well in which a fluid treatment solution is injected through the annulus between a fluid transmission conduit and an exterior conduit and thereafter circulated with produced hydrocarbons through said fluid transmission conduit to the top of said well, comprising:

a casing bore receptacle incorporable in said exterior conduit;

a mandrel incorporable in said fluid transmission conduit;

an annular packoff member comprising inner and outer longitudinally spaced apart sealing means on the inner and outer surfaces of said annular packoff member, respectively, said inner sealing means establishing sealing integrity with said mandrel and said outer sealing means establishing sealing integrity with said exterior conduit; said packoff member being spaced from said casing bore receptacle longitudinally opposite said inner sealing means and spaced from said mandrel longitudinally opposite said outer sealing means;

annular valve means located longitudinally between said inner and outer sealing means for permitting fluid in said annulus above said packoff member to flow between the inner and outer surfaces of said packoff member between said inner and outer sealing means, said valve means being closed when subjected to a net pressure below said packoff member; and means for securing said packoff member to said exterior conduit.

10. The apparatus of claim 9 wherein said means for securing said packoff member to said exterior conduit comprises radially expandable latching means.

11. The apparatus of claim 10 further comprising a receptacle member incorporable in said exterior conduit and comprising a receptacle sealing bore, said outer sealing means establishing sealing integrity along said receptacle sealing bore.

12. The apparatus of claim 11 wherein said receptacle comprises an upwardly facing receptacle shoulder and a downwardly facing receptacle shoulder on opposite sides of said receptacle sealing bore.

13. The apparatus of claim 12 wherein said packoff member further comprises a downwardly facing annular shoulder on the outer surface thereof, said annular shoulder having an outer diameter greater than the inner diameter of and abutting said upwardly facing receptacle shoulder to prevent downward movement of said packoff member relative to said receptacle member.

14. The apparatus of claim 13 wherein said valve means is longitudinally positioned between said annular shoulder and said inner sealing means.

15. The apparatus of claim 9 wherein said packoff member is releasably carriable on said fluid transmission conduit.

16. Apparatus for use in a subterranean well in which a fluid treatment solution is injected is injected through the annulus between a fluid transmission conduit and an exterior conduit, and thereafter circulated with produced hydrocarbons through said fluid transmission conduit to the top of said well, comprising:

a receptacle member incorporable in said exterior conduit;

a mandrel incorporable in said fluid transmission conduit;

an annular packoff member having sealing means thereon for establishing sealing integrity in said annulus between said mandrel and said receptacle member, said packoff member being releasably carriable on said mandrel and having means thereon for engaging said receptacle member to prevent movement of annular packoff member downwardly past said receptacle member;

valve means for permitting flow of said solutions injected through said annulus through said packoff member, said valve means being closed when subjected to a net pressure from below said valve means;

radially expandable latching means on said packoff member for engaging said receptacle member to prevent upward movement of said packoff member relative to said receptacle member; and camming means on said mandrel for urging said latching means radially outward into engagement with said packoff member.

17. The apparatus of claim 16 wherein said camming means urges said latching means radially outward upon downward movement of said mandrel relative to said packoff member.

18. The apparatus of claim 17 further comprising a disengagable sealing member extending between said mandrel and said annular packoff member for preventing the flow of fluids downwardly past said annular packoff member.

19. The apparatus of claim 18 wherein said disengageable sealing member is releasable from said packoff member upon relative movement between said mandrel and said packoff member.

20. The apparatus of claim 16 wherein said radially expandable latching means is releasably secured in a radially retracted position to said mandrel.

21. The apparatus of claim 20 further comprising a lock sleeve member extending at least partially over the exterior of said radially expandable latching means when said latching means is in the retracted position, the attachment between said lock sleeve member and said member comprising a ratcheting connection.

22. The apparatus of claim 21 wherein said ratcheting connection permits said movement of said mandrel upward relative to said lock sleeve member, said lock sleeve member moving with said mandrel upon downward movement of said mandrel.

23. A sealing assembly for controlling the annulus between a fluid transmission conduit and an exterior conduit in a subterranean well and for circulating injected fluids down through said annulus to said production zone and up through said fluid transmission conduit, comprising:

a receptacle member, incorporable in said exterior conduit and having a receptacle sealing bore having an inner diameter less than the local inner diameter of said exterior conduit and extending between an upwardly facing shoulder and a downwardly facing shoulder on said receptacle member;

a mandrel incorporable on said fluid transmission conduit, intermediate the ends thereof;

an annular packoff member releasably carriable on said mandrel and comprising a radially extending member for engaging said upwardly facing shoulder on said receptacle member and radially expandable latching means for engaging said downwardly facing shoulder on said receptacle, said annular packoff member having sealing means on the exterior thereof for providing sealing integrity along said receptacle sealing bore and sealing means on the interior thereof for providing sealing integrity with said mandrel; and valve means in said packoff member for closing said annulus when subjected to net pressure therebelow and for providing communication in said annulus thereabove and therebelow when subjected to a net pressure from above to permit the passage of circulating fluids therethrough.

24. A sealing assembly for controlling the annulus between a fluid transmission conduit and an exterior conduit in a subterranean well and for circulating injected fluids down through said annulus to said production zone and up through said fluid transmission conduit, comprising:

a receptacle member incorporable in said exterior conduit and having a receptacle sealing bore having an inner diameter less than the inner diameter of said exterior conduit and extending between an upwardly facing shoulder and a downwardly facing shoulder on said receptacle member;

a mandrel incorporable on said fluid transmission conduit;

an annular packoff member releasably carriable on said mandrel and comprising a radially extending member for engaging said upwardly facing shoulder on said receptacle member and radially expandable latching means for engaging said downwardly facing shoulder on said receptacle, said annular packoff member having sealing means on the exterior thereof for providing sealing integrity along said receptacle sealing bore and sealing means on the interior thereof for providing sealing integrity with said mandrel; and valve means in said packoff member for closing said annulus when subjected to net pressure therebelow and for providing communication in said annulus thereabove and therebelow when subjected to a net pressure from above to permit the passage of circulating fluids therethrough.

25. A method of sealing the annulus between a fluid transmission conduit and an exterior conduit in a subterranean well to prevent the flow of produced hydrocarbons up through the annulus and of providing for the injection of a fluid treatment solution through said annulus and the circulation of said solution with produced hydrocarbons through said fluid transmission conduit to the top of said well, comprising the steps of:

releasably attaching an annular packoff member having inner and outer seals, a radially expandable latch and a check valve permitting only downward fluid flow around a mandrel section;

incorporating said mandrel section having a flow passage extending therethrough on said fluid transmission conduit;

lowering said fluid transmission into said exterior conduit until said packoff member abuts said exterior conduit to prevent further downward movement of said packoff member relative to said exterior conduit and said outer seals establish sealing integrity with said exterior conduit;

injecting fluid into said annulus, said fluid accumulating above said packoff member and exerting a downward force on said packoff member;

moving said fluid transmission conduit upward to shear an interconnection between said radially expandable latch and said mandrel;

camming said radially expandable latch radially outward into engagement with said exterior conduit by downward movement of said fluid transmission conduit; and removing a disengagable plug to permit flow of injected fluids through said valve and said packoff member by downward movement of said fluid transmission conduit.

26. The method of claim 25 comprising an initial step of incorporating a receptacle member having a receptacle sealing bore for contacting said outer seals into said exterior conduit.

27. A method of sealing the annulus between a fluid transmission conduit and an exterior conduit in a subterranean well to prevent the flow of produced hydrocarbons up through the annulus and of providing for the injection of a fluid treatment solution through said annulus and the circulation of said solution with produced hydrocarbons through said fluid transmission conduit to the top of said well, comprising the steps of:

releasably attaching an annular packoff member having inner and outer seals, a radially expandable latch and a check valve permitting only downward fluid flow around a mandrel section;

incorporating said mandrel section having a flow passage extending therethrough on said fluid transmission conduit;

lowering said fluid transmission into said exterior conduit until said packoff member abuts said exterior conduit to prevent further downward movement of said packoff member relative to said exterior conduit and said outer seals establish sealing integrity with said exterior conduit;

moving said fluid transmission conduit downward to shear an interconnection between said radially expandable latch and said mandrel; and camming said radially expandable latch radially outward into engagement with said exterior conduit by further downward movement of said fluid transmission conduit.

28. The method of claim 27 comprising an initial step of incorporating a receptacle member having a receptacle sealing bore for contacting said outer seals into said exterior conduit.

* * * * *